US006999921B2

(12) United States Patent
Harris et al.

(10) Patent No.: US 6,999,921 B2
(45) Date of Patent: Feb. 14, 2006

(54) AUDIO OVERHANG REDUCTION BY SILENT FRAME DELETION IN WIRELESS CALLS

(75) Inventors: John M. Harris, Chicago, IL (US); Philip J. Fleming, Glen Ellyn, IL (US); Joseph Tobin, Chicago, IL (US)

(73) Assignee: Motorola, Inc., Schaumburg, IL (US)

( * ) Notice: Subject to any disclaimer, the term of this patent is extended or adjusted under 35 U.S.C. 154(b) by 642 days.

(21) Appl. No.: 10/017,811

(22) Filed: Dec. 13, 2001

(65) Prior Publication Data

US 2003/0115045 A1 Jun. 19, 2003

(51) Int. Cl.
*G10L 11/02* (2006.01)

(52) U.S. Cl. ..... 704/215; 704/210

(58) Field of Classification Search ..... 704/215, 704/210, 226–229, 201
See application file for complete search history.

(56) References Cited

U.S. PATENT DOCUMENTS 5,157,728 A 10/1992 Schorman et al.
5,555,447 A 9/1996 Kotzin et al.
5,611,018 A * 3/1997 Tanaka et al. ..... 704/215
5,793,744 A * 8/1998 Kanerva et al. ..... 370/209
6,049,765 A 4/2000 Iyengar et al.
6,122,271 A * 9/2000 McDonald et al. ..... 370/345
6,138,090 A * 10/2000 Inoue ..... 704/212
6,381,568 B1 * 4/2002 Supplee et al. ..... 704/210
6,389,391 B1 * 5/2002 Terauchi ..... 704/233
2002/0097842 A1 7/2002 Guedalia et al.

OTHER PUBLICATIONS

ETSI TS 146 081 v4.0.0: "Discontinuous Transmission (DTX) for Enhanced Full Rate (EFR) speech traffic channels (3GPP) TS 46.081 version 4.0.0 Release 4" Digital Cellular Telecommunications System (Phase 2+); Mar. 2001 internet http://www.elsi.org.

* cited by examiner

*Primary Examiner*—Richemond Dorvil
*Assistant Examiner*—Donald L. Storm
(74) *Attorney, Agent, or Firm*—Jeffrey K. Jacobs

(57) ABSTRACT

To address the need for reducing audio overhang in wireless communication systems (e.g., 100), the present invention provides for the deletion of silent frames before they are converted to audio by the listening devices. The present invention only provides for the deletion of a portion of the silent frames that make up a period of silence or low voice activity in the speaker's audio. Voice frames that make up periods of silence less than a given length of time are not deleted.

18 Claims, 2 Drawing Sheets

AUDIO OVERHANG REDUCTION BY SILENT FRAME DELETION IN WIRELESS CALLS

FIELD OF THE INVENTION

The present invention relates generally to the field of wireless communications and, in particular, to reducing audio overhang in wireless communication systems.

BACKGROUND OF THE INVENTION

Today's digital wireless communications systems packetize and then buffer the voice communications of wireless calls. This buffering, of course, results in the voice communication being delayed. For example, a listener in a wireless call will not hear a speaker begin speaking for a short period of time after he or she actually begins speaking. Usually this delay is less than a second, but nonetheless, it is often noticeable and sometimes annoying to the call participants.

Normal conversation has virtually no delay. When the speaker finishes speaking, a listener can immediately respond having heard everything the speaker has said. Or a listener can interrupt the speaker immediately after the speaker has finished saying something evoking a comment. When substantial delay is introduced into a conversation, however, the flow, efficiency, and spontaneity of the conversation suffer. A speaker must wait for his or her last words to be heard by a listener and then after the listener begins to respond, the speaker must wait through the delay to begin hearing it. Moreover, if a listener interrupts the speaker, the speaker will be at a different point in his or her conversation before beginning to hear what the listener is saying. This can result in confusion and/or wasted time as the participants must stop speaking or ask further questions to clarify. Thus, substantial delay degrades the efficiency of conversations.

However, some delay is a necessary tradeoff in today's wireless communication systems primarily because of the error-prone wireless links. To reduce the number of voice packets that are lost, leaving gaps in the received audio, wireless systems use well-known techniques such as packet retransmission and forward error correction with interleaving across packets. Both techniques require voice packets to be buffered, and thus result in the introduction of some delay. Today's wireless system architectures themselves introduce variable delays that would distort the audio without the use of some buffering to mask these timing variations. For example, packet delivery times will vary in packet networks due to factors such as network loading. Variable delays of voice packets can also be caused by intermittent control signaling that accompanies the voice packets and as a result of a receiving MS handing off to a neighboring base site. Thus, wireless systems are designed to tradeoff the delay that results from a certain level of buffering in order to derive the benefits of providing continuous, uninterrupted voice communication.

Buffering above this optimal level, however, increases the delay experienced by users without any benefits in return. Audio buffered above this optimal level is referred to as "audio overhang." Such audio overhang can occur in wireless systems in certain situations. For example, variability in the time that some wireless systems take to establish wireless links during call setup can result in buffering with audio overhang. Because of the increased delay introduced by audio overhang, the quality of service experienced by these users can suffer substantially. Therefore, there exists a need for reducing audio overhang in wireless communication systems.

DESCRIPTION OF EMBODIMENTS

To address the need for reducing audio overhang in wireless communication systems, the present invention provides for the deletion of silent frames before they are converted to audio by the listening devices. The present invention only provides for the deletion of a portion of the silent frames that make up a period of silence or low voice activity in the speaker's audio. Voice frames that make up periods of silence less than a given length of time are not deleted.

Figure 1:
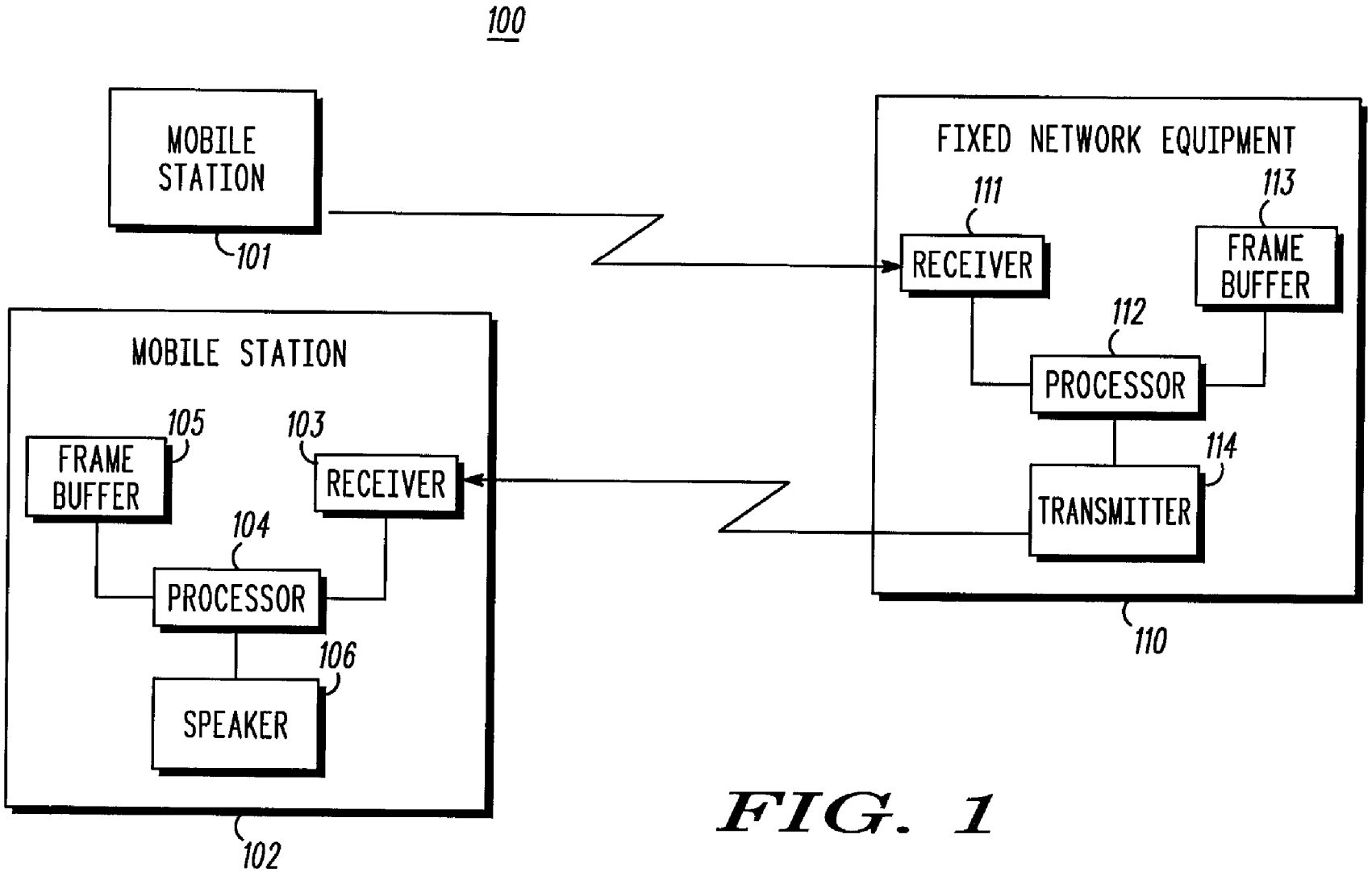
FIG. 1 is a block diagram depiction of a wireless communication system in accordance with an embodiment of the present invention.
Figure 2:
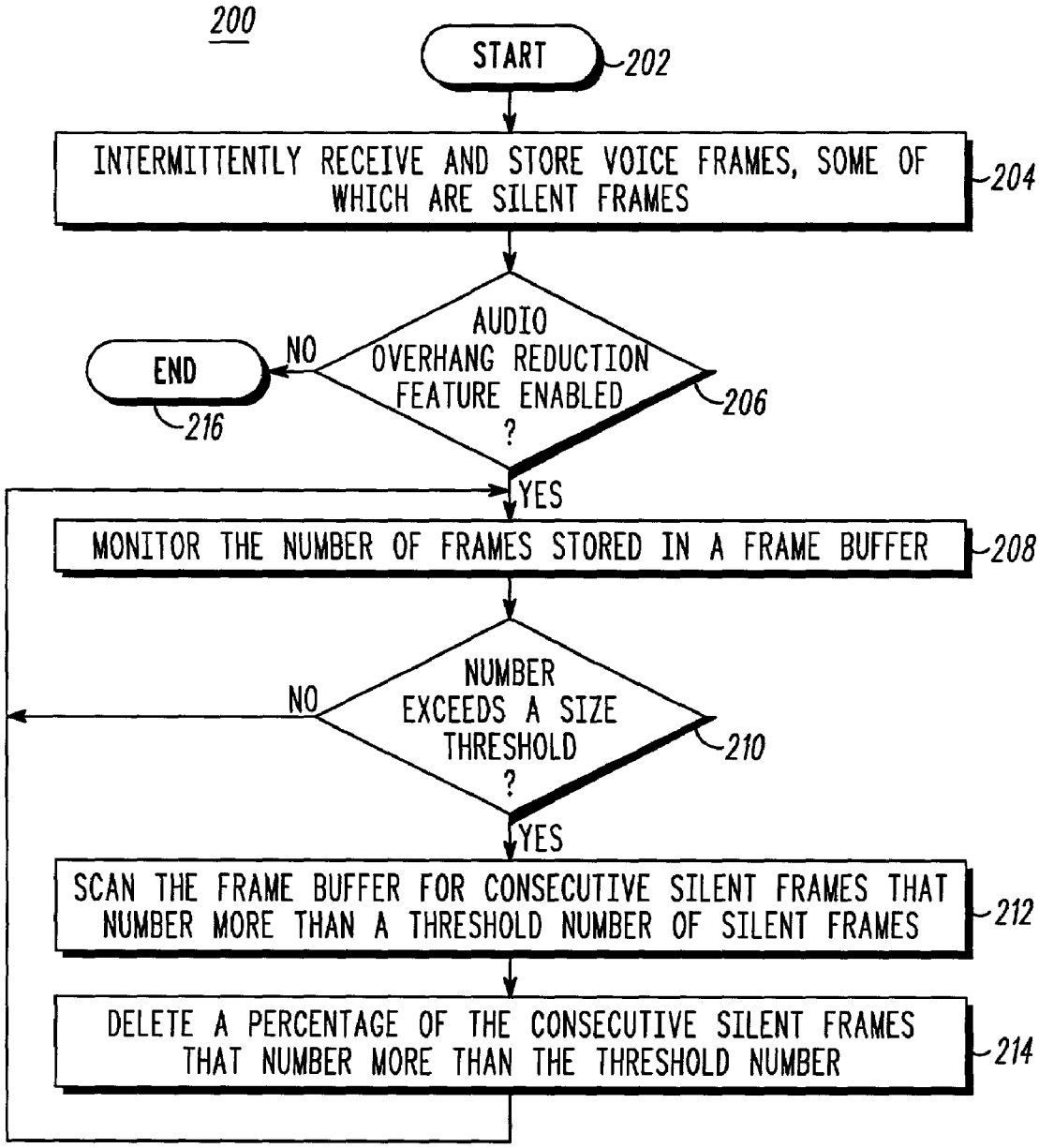
FIG. 2 is a logic flow diagram of steps executed a wireless communication system in accordance with an embodiment of the present invention.

The present invention can be more fully understood with reference to FIGS. 1 and 2. FIG. 1 is a block diagram depiction of wireless communication system 100 in accordance with an embodiment of the present invention. System 100 comprises a system infrastructure, fixed network equipment (FNE) 110, and numerous mobile stations (MSs), although only MSs 101 and 102 are shown in FIG. 1's simplified system depiction. MSs 101 and 102 comprise a common set of elements. Receivers, processors, buffers (i.e., portions of memory), and speakers are all well known in the art. In particular, MS 102 comprises receiver 103, speaker 106, frame buffer 105, and processor 104 (comprising one or more memory devices and processing devices such as microprocessors and digital signal processors).

FNE 110 comprises well-known components such as base sites, base site controllers, a switch, and additional well-known infrastructure equipment not shown. To illustrate the present invention simply and concisely, FNE 110 has been depicted in block diagram form showing only receiver 111, processor 112, frame buffer 113, and transmitter 114. Virtually all wireless communication systems contain numerous receivers, transmitters, processors, and memory buffers. They are typically implemented in and across various physical components of the system. Therefore, it is understood that receiver 111, processor 112, frame buffer 113, and transmitter 114 may be implemented in and/or across different physical components of FNE 110, including physical components that are not even co-located. For example, they may be implemented across multiple base sites within FNE 110.

Operation of an embodiment of system 100 occurs substantially as follows. MSs 101 and 102 are in wireless communication with FNE 110. For purposes of illustration, MSs 101 and 102 will be assumed to be involved in a group dispatch call in which the user of MS 101 has depressed the push-to-talk (PTT) button and is speaking to the other dispatch users of the talkgroup. One of these users is the user of MS 102 who is listening to the MS 101 user speak via speaker 106. Receiver 111 receives the voice frames that convey the voice information of the call from MS 101. Some of these frames are so-called "silent frames." In one embodiment, these frames have been marked by MS 101 to indicate that they convey either low voice activity or no voice activity. Depending on how the voice frames are voice encoded (or vocoded) these silent frames may be frames that are flagged by the vocoder as minimum rate frames (e.g., ⅛ th rate frames) or flagged as silence suppressed frames. Additionally, the silent intervals may be conveyed through the use of time stamps on the non silent frames such that the silent frames do not need to be actually sent.

Processor 112 stores the voice frames in frame buffer 113 after they are received. When frames are ready for transmission to MS 102, processor 112 extracts them and instructs the transmitter to transmit the extracted voice frames to MS 102. In similar fashion, receiver 103 then receives the voice frames from FNE 110, and processor 104 stores them in frame buffer 105. The voice frames may be received by receiver 103 via Radio Link Protocol (RLP) or Forward Error Correction. As required to maintain the stream of audio for MS 102's user, processor 104 also regularly extracts the next voice frame from frame buffer 105 and de-vocodes it to produce an audio signal for speaker 106 to play.

In order to reduce the audio overhang time, however, the present invention provides for the deletion of some of the silent frames before they are used to generate an audio signal. In one embodiment, the present invention is implemented in both the FNE and the receiving MS, although it could alternatively be implemented in either the FNE or the MS. If implemented in both, then both processor 104 and processor 112 will be monitoring the number of voice frames stored in frame buffer 105 and frame buffer 113, respectively, as frames are being added and extracted. When the number of frames stored in either buffer exceeds a predetermined size threshold (e.g., 300 milliseconds worth of voice frames), then processor 104/112 attempts to delete one or more silent frames.

There are a number of embodiments, all of which or some combination of which may be employed to delete silent frames. In one embodiment, processor 104/112 scans frame buffer 105/113 for consecutive silent frames longer than a predetermined length (e.g., 90 msecs) and deletes a percentage (e.g., 25%) of the consecutive silent frames that exceed this length. In another embodiment, processor 104/112 monitors the voice frames as they are stored in the buffer. Processor 104/112 determines that a threshold number of consecutive silent frames have been stored in the frame buffer and deletes a percentage of subsequent consecutive silent frames as they are being received and stored. In another embodiment, the deletion processing is triggered by the receipt of the last voice frame of each dispatch session within the dispatch call. Processor 104/112 determines that a threshold number of silent frames have been consecutively stored in the frame buffer prior to the last voice frame and deletes a percentage of prior consecutive silent frames.

Regardless which deletion embodiment(s) are implemented, deleting silent frames from either frame buffer has the effect of removing that portion of the audio from what speaker 106 would otherwise play. Thus, the pauses in the original audio captured by MS 101, at least those of a certain length or longer, are shortened, and audio overhang thereby reduced. While the benefits of reduced overhang are clear (as discussed in the Background section above), the shortening of pauses or gaps in a user's speech as received by listeners may not be desirable to some users. Thus, this overhang reduction mechanism may need to be implemented as a user selected feature that can be turned on and off by mobile users.

Another ill effect of audio overhang is that in a group dispatch call, the listening users wait for the speaking user's audio, as played by their MS, to complete before attempting to press the PTT to become the speaker of the next dispatch session of the call. The greater the audio overhang the longer the listener waits before trying to speak. To address this inefficiency, when MS 102 receives the last voice frame of a dispatch session within the call, MS 102 indicates to its user that the dispatch session has ended and that another dispatch session may be initiated. This indication may be visual (e.g., using the display), auditory (e.g., a beep or tone), or through vibration, for example. A listener could press his or her PTT upon such an indication, the MS discard the previous speaker's unplayed audio, and the new speaker begin speaking to the group without the overhang delay.

FIG. 2 is a logic flow diagram of steps executed a wireless communication system in accordance with an embodiment of the present invention. Logic flow 200 begins (202) with a communication device (an MS and/or FNE) intermittently receiving (204) and storing voice frames in a frame buffer, as it does throughout the duration of a wireless call. When (206) the audio overhang feature is enabled, the number of frames stored in the buffer is monitored (208). When (210) the number stored exceeds a threshold or maximum number, then the wireless call is developing overhang, and thus delay beyond what is optimal. To reduce this overhang, the communication device, in the most general embodiment, scans (212) the frame buffer for groups of consecutive silent frames. For the groups that are longer than a minimum silence period, a percentage of the silent frames that are in excess of the minimum silence period are deleted (214). Thus, the overhang is reduced. Throughout the wireless call, then, the communication device is monitoring for an overhang condition and deleting silent frames when an overhang condition develops.

While the present invention has been particularly shown and described with reference to particular embodiments thereof, it will be understood by those skilled in the art that various changes in form and details may be made therein without departing from the spirit and scope of the present invention.

The invention claimed is:

1. A method for reducing audio overhang in a wireless call comprising the steps of:

receiving voice frames that convey voice information for the wireless call, wherein at least some of the frames, silent frames, indicate that a portion of the wireless call comprises low voice activity or no voice activity;

monitoring the number of voice frames stored in a frame buffer after being received; and when the number of voice frames stored in the frame buffer exceeds a size threshold and when a threshold number of silent frames have been consecutively stored in the frame buffer, deleting at least one silent frame that was received thereby preventing conversion of the at least one silent frame to audio.

2. The method of claim 1 wherein the step of deleting comprises the steps of:

scanning the frame buffer for consecutive silent frames that number more than a threshold number of silent frames; and deleting a percentage of the consecutive silent frames that number more than the threshold number.

3. The method of claim 1 wherein the step of deleting comprises the steps of:

determining that a threshold number of consecutive silent frames have been stored in the frame buffer; and deleting a percentage of subsequent consecutive silent frames.

4. The method of claim 1 wherein the step of deleting comprises the steps of:

receiving a last voice frame that is the last voice frame of a dispatch session within the dispatch call;

determining that a threshold number of silent frames have been consecutively stored in the frame buffer prior to the last voice frame; and deleting a percentage of prior consecutive silent frames.

5. The method of claim 1 wherein the step of deleting comprises deleting the at least one silent frame when the number of voice frames stored in the frame buffer exceeds the size threshold and an audio overhang reduction feature is enabled.

6. The method of claim 1 wherein the size threshold is the number of voice frames that would comprise approximately 500 milliseconds of audio.

7. The method of claim 1 wherein the silent frames have been marked by a mobile station from which the silent frames originated to indicate when received that the silent frames convey low voice activity or no voice activity.

8. The method of claim 1 wherein the steps of the method are performed by a mobile station in the wireless call.

9. The method of claim 8 wherein the step of receiving comprises receiving voice frames via Radio Link Protocol (RLP).

10. The method of claim 8 wherein the step of receiving comprises receiving voice frames via a Forward Error Correction.

11. The method of claim 8 wherein the wireless call is a dispatch call.

12. The method of claim 8 wherein the step of receiving comprises the step of receiving a voice frame that is the last voice frame of a dispatch session within the dispatch call and wherein the method further comprises the step of indicating to a user of the mobile station, upon receiving the last voice frame of a dispatch session, that the dispatch session has ended and that another dispatch session may be initiated by the user.

13. The method of claim 1 performed by fixed network equipment facilitating the wireless call.

14. The method of claim 13 further comprising the step of extracting voice frames from the frame buffer for transmission to at least one mobile station in the wireless call.

15. A mobile station (MS) comprising:

a frame buffer;

a receiver adapted to receive voice frames that convey voice information for a wireless call, wherein at least some of the frames, silent frames, indicate that a portion of the wireless call comprises low voice activity or no voice activity; and a processor adapted to monitor the number of voice frames stored in the frame buffer after being received and adapted to delete at least one silent frame that was received thereby preventing conversion of the at least one silent frame to audio, when the number of voice frames stored in the frame buffer exceeds a size threshold and when a threshold number of silent frames have been consecutively stored in the frame buffer.

16. The MS of claim 15 wherein the processor is further adapted to regularly extract a next voice frame from the frame buffer and to de-vocode the next voice frame into an audio signal.

17. Fixed network equipment (FNE) comprising:

a frame buffer;

a receiver adapted to receive voice frames that convey voice information for a wireless call, wherein at least some of the frames, silent frames, indicate that a portion of the wireless call comprises low voice activity or no voice activity; and a processor adapted to monitor the number of voice frames stored in the frame buffer after being received and adapted to delete at least one silent frame that was received thereby preventing conversion of the at least one silent frame to audio, when the number of voice frames stored in the frame buffer exceeds a size threshold and when a threshold number of silent frames have been consecutively stored in the frame buffer.

18. The FNE of claim 17 further comprising a transmitter, wherein the processor is further adapted to extract voice frames from the frame buffer and to instruct the transmitter to transmit the extracted voice frames to at least one mobile station in the wireless call.

* * * * *